US012808010B2

(12) United States Patent
Yang et al.

(10) Patent No.: US 12,808,010 B2
(45) Date of Patent: Nov. 24, 2026

(54) HIGH-STRENGTH STEEL AND METHOD OF MANUFACTURING THE SAME

(71) Applicant: CHINA STEEL CORPORATION, Kaohsiung (TW)

(72) Inventors: Kuo-Cheng Yang, Kaohsiung (TW); Jui-Fan Tu, Kaohsiung (TW); Tso-Feng Wu, Kaohsiung (TW); Chih-Kai Chen, Kaohsiung (TW); Po-Cheng Hsieh, Kaohsiung (TW)

(73) Assignee: CHINA STEEL CORPORATION, Kaohsiung (TW)

( * ) Notice: Subject to any disclaimer, the term of this patent is extended or adjusted under 35 U.S.C. 154(b) by 412 days.

(21) Appl. No.: 18/423,317

(22) Filed: Jan. 26, 2024

(65) Prior Publication Data

US 2025/0092481 A1 Mar. 20, 2025

(30) Foreign Application Priority Data

Sep. 18, 2023 (TW) ..... 112135475

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 1/84* (2013.01); *C21D 6/002* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01);
(Continued)

(58) Field of Classification Search
CPC ... C21D 9/46; C21D 1/18; C21D 1/84; C21D 6/002; C21D 6/005; C21D 6/008; C21D 8/02; C21D 8/0226; C21D 8/0236; C21D 8/0263; C21D 8/0278; C21D 2211/005; C21D 2211/008; C21D 2211/002; C22C 38/001; C22C 38/002; C22C 38/02; C22C 38/04; C22C 38/06; C22C 38/22; C22C 38/28; C22C 38/32; C22C 38/38
USPC ..... 148/623
See application file for complete search history.

(56) References Cited

U.S. PATENT DOCUMENTS

2017/0022582 A1* 1/2017 Takashima ..... B22D 11/001

FOREIGN PATENT DOCUMENTS

CN 113316649 A 8/2021
CN 114086071 A 2/2022
(Continued)

OTHER PUBLICATIONS

WO2022249919A1 (machine translation) (Year: 2022).*

*Primary Examiner* — Danielle M. Carda
*Assistant Examiner* — Nazmun Nahar Shams
(74) *Attorney, Agent, or Firm* — CKC & Partners Co., LLC

(57) ABSTRACT

The present disclosure relates to a high-strength steel and a method of manufacturing the same. Slab with specific composition is subjected to a rolling process and a heat treatment process with specific conditions for changing the metallographic structure of the obtained steel. The obtained steel includes at least 95% tempered martensite, and has a high tensile strength and a high yield strength.

10 Claims, 3 Drawing Sheets

(51) Int. Cl.

| | |
|---|---|
| ***C21D 1/84*** | (2006.01) |
| ***C21D 6/00*** | (2006.01) |
| ***C21D 8/02*** | (2026.01) |
| ***C21D 8/0221*** | (2026.01) |
| ***C21D 8/0247*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |

(52) U.S. Cl.
CPC ..... *C22C 38/28* (2013.01); *C22C 38/32* (2013.01); *C22C 38/38* (2013.01); *C21D 2211/005* (2013.01); *C21D 2211/008* (2013.01)

(56) References Cited

FOREIGN PATENT DOCUMENTS

| | | | | | |
|---|---|---|---|---|---|
| CN | 116547400 | A | | 8/2023 | |
| WO | WO-2022249919 | A1 | * | 12/2022 | ..... C21D 8/02 |

* cited by examiner

HIGH-STRENGTH STEEL AND METHOD OF MANUFACTURING THE SAME

RELATED APPLICATION

This application claims priority to Taiwan Application Serial Number 112135475, filed Sep. 18, 2023, which is herein incorporated by reference.

BACKGROUND

Field of Invention

The present disclosure relates to a high-strength steel and a method of manufacturing the same. The method of manufacturing the steel of the present disclosure excludes retempering, and can obtain the steel with a high tensile strength, a high yield strength, and a high yield ratio.

Description of Related Art

Martensite is the hardest structure in steels. Martensite can be applied in parts such as door impact bars for vehicles to replace tubular parts for reducing manufacturing costs. In addition, martensite can also be used in vehicle bumpers, A-, B- and C-pillar reinforcements, underfloor tunnels, etc., so as to reduce the weights of vehicles and to maintain their safety, thereby meeting the requirements including energy conservation and carbon reduction of fuel vehicles, as well as improved endurance of electric vehicles.

Traditionally, a hot stamping process is used to form a martensite steel. Steel is initially subjected to a first heat treatment in a steel factory, which prevents the hardness of the steel from being too high and beneficially processes the steel into a blank. Then, the blank is heated to a temperature above Ac3 in a second heat treatment, so that the microstructure in the blank is fully transformed into austenite. Next, the blank is put into a mold, and then undergoes a hot stamping and a cooling treatment, so that the final microstructure of the steel is composed mainly of martensite, thereby obtaining the steel with a high tensile strength (TS).

However, since the mold is generally cooled in only one stage and hardly cooled in multiple stages, such martensite has no tempering properties and low yield strength (YS), and its yield ratio (YS/TS) is difficultly increased. In addition, the hot stamping process requires additional investment in equipment and the steel is necessarily heated twice (e.g., tempered). As a result, the hot stamping has high manufacturing costs and high energy losses.

Therefore, it is urgent to provide a high-strength steel and a method of manufacturing the same to solve the above problems.

SUMMARY

One aspect of the present disclosure is to provide a high-strength steel and a method of manufacturing the same, wherein a volume ratio of tempered martensite of the high-strength steel is not less than 95%. The method of manufacturing the high-strength steel excludes retempering, and the steel with a high tensile strength, a high yield strength, and a high yield ratio can be obtained. Therefore, the high-strength steel and method of manufacturing the same of the present disclosure can reduce the cost and energy loss of manufacturing steel.

At least one embodiment of the present disclosure is to provide a method of manufacturing a high-strength steel, and the method includes the following steps. First, a slab is provided, wherein based on a total weight of the slab as 100% by weight, the slab includes 0.16 weight percent to 0.25 weight percent of carbon, 0.15 weight percent to 0.55 weight percent of silicon, no more than 2 weight percent of manganese, no more than 0.55 weight percent of chromium, no more than 0.2 weight percent of molybdenum, no more than 0.05 weight percent of titanium, no more than 0.06 weight percent of aluminum, no more than 0.004 weight percent of boron, no more than 0.006 weight percent of nitrogen, no more than 0.02 weight percent of phosphorus, no more than 0.002 weight percent of sulfur, a remaining amount of iron, and unavoidable impurities. Then, a heating step is performed on the slab to obtain a heated slab. Next, a hot rolling step is performed on the heated slab to obtain a hot rolled steel plate. Then, a cold rolling step is performed on the hot rolled steel plate to obtain a cold rolled steel plate. Next, an annealing step is performed on the cold rolled steel plate to obtain an annealed steel plate. Then, a cooling step is performed on the annealed steel plate to obtain a cooled steel plate. The cooling step includes the following operations in sequence: cooling the annealed steel plate to no less than 680 °C at a cooling rate between 5 °C/second and 20 °C/second; cooling the annealed steel plate to no higher than 400 °C at a cooling rate between 30 °C/second and 300 °C/second; and cooling the annealed steel plate to between 250 °C and 300 °C at a cooling rate between 10 °C/second and 40 °C/second. Thereafter, an over aging process is performed on the cooled steel plate to obtain the high-strength steel, wherein a volume ratio of tempered martensite in the high-strength steel is not less than 95%.

In at least one embodiment of the present disclosure, a heating temperature in the above heating step is between 1150 °C and 1300 °C, and the heating step is maintained for 2 hours to 4 hours. A finish rolling temperature in the above hot rolling step is between 880 °C and 950 °C, and a coiling temperature in the above hot rolling step is between 500 °C and 700 °C In at least one embodiment of the present disclosure, a cold rolling percentage in the above cold rolling step is at least 50%.

In at least one embodiment of the present disclosure, the method of manufacturing the high-strength steel further includes: before the cold rolling step, a pickling step is performed on the hot rolled steel plate.

In at least one embodiment of the present disclosure, an annealing temperature in the annealing step is above 840 °C, and an annealing time in the annealing step is between 90 seconds to 600 seconds.

In at least one embodiment of the present disclosure, the annealing temperature in the annealing step is between 840 °C and 940 °C In at least one embodiment of the present disclosure, in the step of cooling the annealed steel plate to no higher than 400 °C at a cooling rate between 30 °C/second and 300 °C/second, a cooling temperature of the annealed steel plate is between 300 °C and 400 °C In at least one embodiment of the present disclosure, a processing temperature in the above over aging process is between 200 °C and 250 °C, and a processing time in the over aging process is between 2 minutes to 25 minutes.

In at least one embodiment of the present disclosure, a total volume ratio of ferrite and bainite is no more than 5%.

In at least one embodiment of the present disclosure, the method of manufacturing the high-strength steel excludes retempering.

At least one embodiment of the present disclosure is to provide a high-strength steel. The high-strength steel is obtained by the above-mentioned method of manufacturing the high-strength steel, wherein the high-strength steel includes 0.16 weight percent to 0.25 weight percent of carbon, 0.15 weight percent to 0.55 weight percent of silicon, no more than 2 weight percent of manganese, no more than 0.55 weight percent of chromium, no more than 0.2 weight percent of molybdenum, no more than 0.05 weight percent of titanium, no more than 0.06 weight percent of aluminum, no more than 0.004 weight percent of boron, no more than 0.006 weight percent of nitrogen, no more than 0.02 weight percent of phosphorus, no more than 0.002 weight percent of sulfur, a remaining amount of iron, and unavoidable impurities. A volume ratio of tempered martensite in the high-strength steel is not less than 95%.

In at least one embodiment of the present disclosure, the high-strength steel includes 0.2 weight percent to 0.55 weight percent of silicon.

In at least one embodiment of the present disclosure, a tensile strength of the high-strength steel is not less than 1300 MPa.

In at least one embodiment of the present disclosure, a yield strength of the high-strength steel is not less than 1050 MPa.

In at least one embodiment of the present disclosure, a yield ratio of the high-strength steel is not less than 0.8.

BRIEF DESCRIPTION OF THE DRAWINGS

In order to make the above and other objects, features, advantages, and embodiments of the present disclosure more apparent and understandable, detailed descriptions of the accompanying drawings are as follows.

DETAILED DESCRIPTION

The manufactures and uses of embodiments of the present disclosure are discussed in detail below. However, it is to be understood that the embodiments provide many applicable inventive concepts that can be embodied in a wide variety of specific contexts. The specific embodiments discussed are illustrative only and are not intended to limit the scope of the present disclosure.

In the present disclosure, the range expressed by "one value to another value" is a summary expression that avoids enumerating all the values in the range one by one in the specification. Therefore, the description of a specific range covers any value within that numerical range and a smaller numerical range bounded by any numerical value within that numerical range. It is the same as the arbitrary numerical value and the smaller numerical range is expressly written in the specification.

Figure 1:
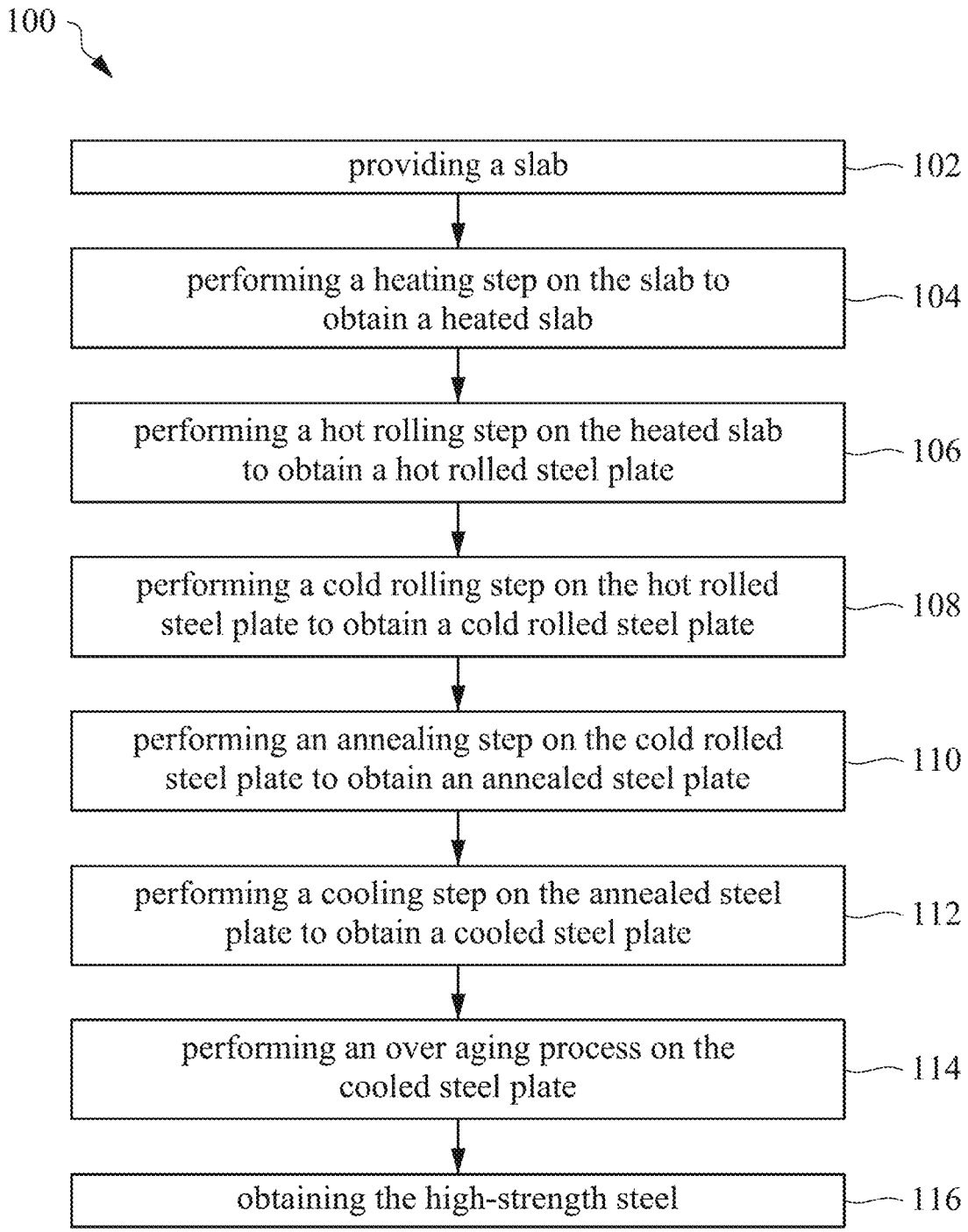
FIG. 1 is a flowchart of a method of manufacturing a high-strength steel according to some embodiments of the present disclosure.

Reference is made to FIG. 1. FIG. 1 is a flowchart of a method 100 of manufacturing the high-strength steel according to some embodiments of the present disclosure. First, as shown in a step 102 of the method 100, a slab is provided. Based on a total weight of the slab as 100% by weight, the slab includes 0.16 weight percent to 0.25 weight percent of carbon, 0.15 weight percent to 0.55 weight percent of silicon, no more than 2 weight percent of manganese, no more than 0.55 weight percent of chromium, no more than 0.2 weight percent of molybdenum, no more than 0.05 weight percent of titanium, no more than 0.06 weight percent of aluminum, no more than 0.004 weight percent of boron, no more than 0.006 weight percent of nitrogen, no more than 0.02 weight percent of phosphorus, no more than 0.002 weight percent of sulfur, a remaining amount of iron, and unavoidable impurities.

If a content of carbon of the above-mentioned slab was less than 0.16 weight percent, a hardness of the resulting steel would be insufficient. If the content of carbon of the above-mentioned slab was greater than 0.25 weight percent, the weldability of the resulting steel would be poor, and would be disadvantage to mass production and the jointing of parts would tend to failure.

If a content of silicon of the above-mentioned slab was less than 0.15 weight percent, a strength of the resulting steel could not be effectively improved. If a content of silicon of the above-mentioned slab was greater than 0.55 weight percent, the ferrite and the residual austenite would be increased, so that a yield ratio of the resulting steel could not be increased.

If a content of manganese of the above-mentioned slab was greater than 2 weight percent, it would be difficult to temper, the disclosed steel with the high tensile strength, the high yield strength, and the high yield ratio could not be obtained.

If a content of chromium of the above-mentioned slab was greater than 0.55 weight percent, the disclosed steel with the high tensile strength, the high yield strength, and the high yield ratio could not be obtained.

If a content of molybdenum of the above-mentioned slab was greater than 0.2 weight percent, the disclosed steel with the high tensile strength, the high yield strength, and the high yield ratio could not be obtained.

If a content of titanium of the above-mentioned slab was greater than 0.05 weight percent, the disclosed steel with the high tensile strength, the high yield strength, and the high yield ratio could not be obtained.

If a content of aluminum of the above-mentioned slab was greater than 0.06 weight percent, the disclosed steel with the high tensile strength, the high yield strength, and the high yield ratio could not be obtained.

If a content of boron of the above-mentioned slab was greater than 0.004 weight percent, the disclosed steel with the high tensile strength, the high yield strength, and the high yield ratio could not be obtained.

If a content of nitrogen of the above-mentioned slab was greater than 0.006 weight percent, the disclosed steel with the high tensile strength, the high yield strength, and the high yield ratio could not be obtained.

If a content of phosphorus of the above-mentioned slab was greater than 0.02 weight percent, the disclosed steel with the high tensile strength, the high yield strength, and the high yield ratio could not be obtained.

If a content of sulfur of the above-mentioned slab was greater than 0.002 weight percent, the disclosed steel with the high tensile strength, the high yield strength, and the high yield ratio could not be obtained.

Next, as shown in a step 104 of the method 100, a heating step is performed on the slab to obtain a heated slab. A heating temperature in the heating step is between 1150 °C and 1300 °C The heating step is maintained for 2 hours to 4 hours. If the heating temperature and the heating time were in the above-mentioned ranges, it would be beneficial to form the disclosed steel with the high tensile strength, the high yield strength, and the high yield ratio.

Next, as shown in a step 106 of the method 100, a hot rolling step is performed on the heated slab to obtain a hot rolled steel plate. A finish rolling temperature in the hot rolling step is between 880 °C and 950 °C A coiling temperature in the hot rolling step is between 500 °C and 700 °C In some embodiments, after the hot rolling step, a pickling step is performed on the hot rolled steel plate to remove the scale on the surface of the hot rolled steel plate.

Next, as shown in a step 108 of the method 100, a cold rolling step is performed on the hot rolled steel plate to obtain a cold rolled steel plate. A cold rolling step in the cold rolling step is at least 50%. If the cold rolling percentage was at least 50%, it would be beneficial to form the disclosed steel with the high tensile strength, the high yield strength, and the high yield ratio.

Next, as shown in a step 110 of the method 100, an annealing step is performed on the cold rolled steel plate to obtain an annealed steel plate. An annealing temperature in the annealing step is above 840 °C, such as 840 °C to 940 °C An annealing time in the annealing step is between 90 seconds to 600 seconds.

Next, as shown in a step 112 of the method 100, a cooling step is performed on the annealed steel plate to obtain a cooled steel plate. The cooling step includes the following operations in sequence: (1) the annealed steel plate is cooled to no less than 680 °C at a cooling rate between 5 °C/second and 20 °C/second. (2) Then, the annealed steel plate is cooled to no higher than 400 °C at a cooling rate between 30 °C/second to 300 °C/second. (3) Subsequently, the annealed steel plate is cooled to between 250 °C and 300 °C at a cooling rate between 10 °C/second and 40 °C/second.

In the above-mentioned cooling step (1), if the cooling rate was less than 5 °C/second or higher than 20 °C/second, it would affect the metallographic structure and its proportion of the subsequently obtained steel. In the above-mentioned cooling step (1), if cooling temperature was below 680 °C, too much ferrite would be generated, which would affect the metallographic structure and its proportion of the subsequently obtained steel.

Figure 2:
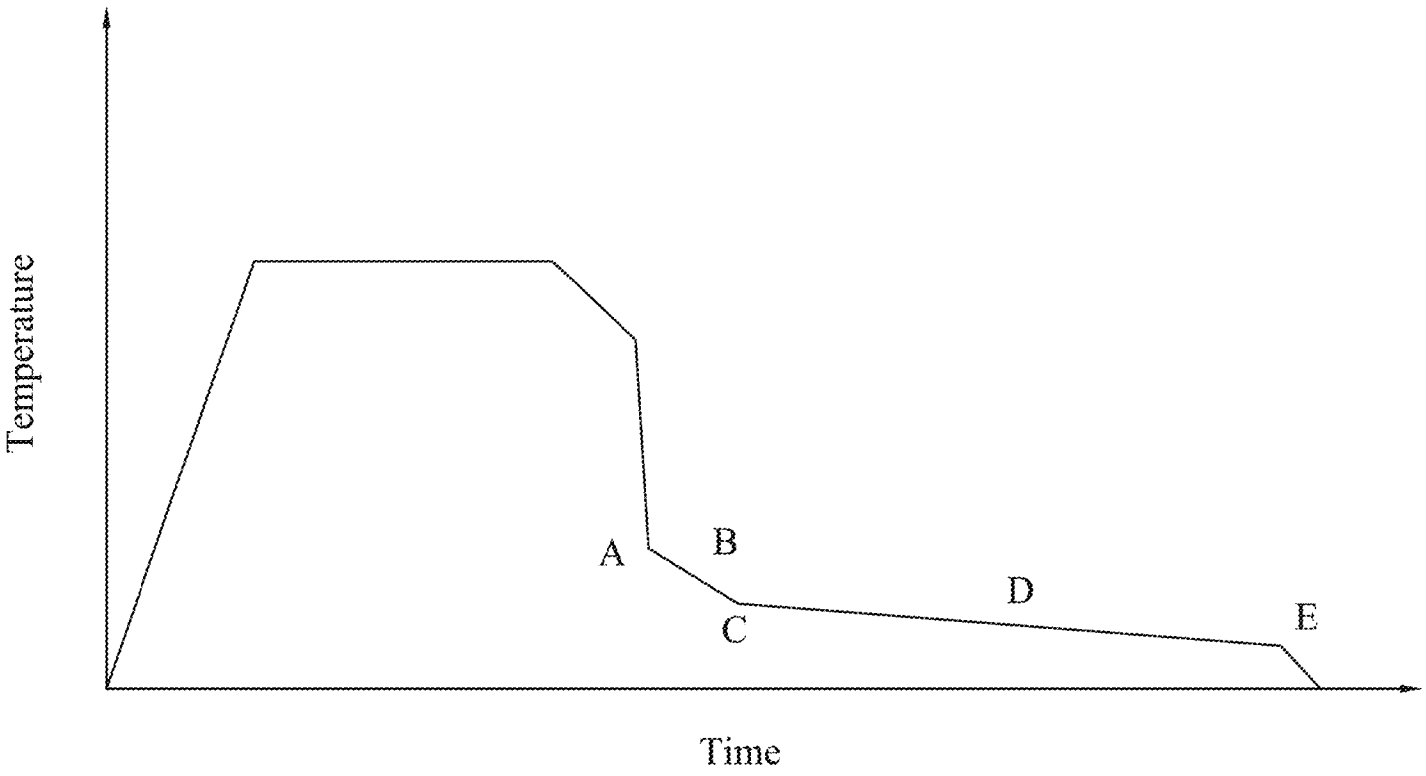
FIG. 2 is a schematic diagram of a heat treatment according to some embodiments of the present disclosure.

In the above-mentioned cooling step (2), if the cooling rate was less than 30 °C/second, too much bainite would be generated, which would reduce the tensile strength of the subsequently obtained steel. In the above-mentioned cooling step (2), if a cooling temperature was higher than 400 °C, too much bainite would be generated, which would reduce the tensile strength of the subsequently obtained steel. In some embodiments, the cooling temperature is no higher than 400 °C, such as 300 °C to 400 °C Reference is made to FIG. 2. FIG. 2 is a schematic diagram of a heat treatment according to some embodiments of the present disclosure. It can be understood that, in a step 114 of the method 100, a cooling temperature in the cooling step (2) corresponds to a point A in FIG. 2.

In the above-mentioned cooling step (3), if the cooling rate was less than 10 °C/second or higher than 40 °C/second, it would affect the metallographic structure and its proportion of the subsequently obtained steel. In the present embodiment, a cooling temperature (also referred to as a "final temperature of rapid cooling") in the cooling step (3) is between 250 °C and 300 °C If the cooling temperature in the cooling step (3) was below 250 °C, both the tensile strength and the yield strength of the subsequently obtained steel would increase, but the yield ratio of the subsequently obtained steel could not increase. If the cooling temperature in the cooling step (3) was higher than 300 °C, both the tensile strength and the yield strength of the subsequently obtained steel would decrease, but the yield ratio of the subsequently obtained steel could not increase.

It can be understood that, in FIG. 2, the cooling step (3) corresponds to a line segment B, and cooling temperature in the cooling step (3) corresponds to a point C.

Next, as shown in the step 114 and a step 116 of the method 100, an over aging process is performed on the cooled steel plate to obtain a high-strength steel. A processing temperature in the over aging process is between 200 °C and 250 °C A processing time in the over aging process is between 2 minutes to 25 minutes. If the processing temperature and the processing time were in the above-mentioned ranges, it would be beneficial to form the disclosed steel with the high tensile strength, the high yield strength, and the high yield ratio.

It can be understood that, in FIG. 2, the step 114 of the method 100 corresponds to a line segment D, and a finishing temperature in the step 114 (the over aging process) corresponds to a point E.

A volume ratio of tempered martensite in the obtained high-strength steel is not less than 95%. In some embodiments, the volume ratio of tempered martensite is not less than 95%, and a total volume ratio of ferrite and bainite is no more than 5%.

The present disclosure also discloses a high-strength steel which is obtained by using the above-mentioned method. The high-strength steel includes 0.16 weight percent to 0.25 weight percent of carbon, 0.15 weight percent to 0.55 weight percent of silicon, no more than 2 weight percent of manganese, no more than 0.55 weight percent of chromium, no more than 0.2 weight percent of molybdenum, no more than 0.05 weight percent of titanium, no more than 0.06 weight percent of aluminum, no more than 0.004 weight percent of boron, no more than 0.006 weight percent of nitrogen, no more than 0.02 weight percent of phosphorus, no more than 0.002 weight percent of sulfur, a remaining amount of iron, and unavoidable impurities.

The tensile strength of the obtained high-strength steel is not less than 1300 MPa, the yield strength of the obtained high-strength steel is not less than 1050 MPa, and the yield ratio of the obtained high-strength steel is not less than 0.8.

It is worth noting that the present disclosure only has one heating step (i.e., the step 104) and excludes other additional heating steps. Specifically, after the step 104, the disclosed steel with the high tensile strength, the high yield strength, and the high yield ratio is formed by three times of cooling step. In the cooling steps, the cooling rates and the cooling temperatures are controlled to form at least 95% tempered martensite. Therefore, compared with the traditional process that requires reheating steps to produce martensite, the method of manufacturing the high-strength steel of the present disclosure can reduce the cost and energy loss of manufacturing steel.

The following Experimental Examples are used to describe the applications of the present disclosure, but they are not intended to limit the present disclosure. Those skilled in the art may make various changes and alterations herein without departing from the spirit and scope of the present disclosure.

Experimental Example 1

Please refer to the slab compositions shown in Table 1. First, a slab is heated at a heating temperature of 1150 °C to 1300 °C and is heated for 2 hours to 4 hours to obtain a heated slab. Next, a hot rolling step is performed on the heated slab to obtain a hot rolled steel plate, wherein a finish rolling temperature is between 880 °C and 950 °C and a coiling temperature is between 500 °C and 700 °C Then, a cold rolling step is performed on the hot rolled steel plate to obtain a cold rolled steel plate, wherein a cold rolling percentage in the cold rolling step is at least 50%. After that, an annealing step is performed on the cold rolled steel plate to obtain an annealed steel plate, wherein an annealing temperature is above 840 °C and an annealing time is between 90 seconds to 600 seconds.

Next, a first cooling step is performed on the annealed steel plate, wherein a cooling rate of the first cooling step is between 5 °C/second and 20 °C/second, and a cooling temperature of the first cooling step is no less than 680 °C Then, a second cooling step is performed, wherein a cooling rate of the second cooling step is at least 30 °C/second, and a cooling temperature in a second cooling step is no higher than 400 °C After that, a third cooling step is performed to form a cooled steel plate, wherein a cooling rate of the third cooling step is between 10 °C/second and 40 °C/second, and a cooling temperature in the third cooling step is between 250 °C and 300 °C Please refer to Table 2 and FIG. 2. "O" shown in the point A represented that the cooling temperature in the second cooling step was no higher than 400 °C, and "X" shown in the point A represented that the cooling temperature in the second cooling step was higher than 400 °C "O" shown in the line segment B represented that the cooling rate in the third cooling step was between 10 °C/second and 40 °C/second, and "X" shown in the line segment B represented that the cooling rate in the third cooling step was lower than 10 °C/second or higher than 40 °C/second. "O" shown in the point C represented that the cooling temperature in the third cooling step was between 250 °C and 300 °C, and "X" in the point C represented that the cooling temperature in the third cooling step was lower than 250 °C "O" shown in the line segment D represented that the processing temperature in the over aging process was no higher than 250 °C, and "X" in the line segment D represented that the processing temperature in the over aging process was higher than 250 °C "O" shown in the point E represented that the finishing temperature in the over aging process was no higher than 200 °C, and "X" shown in the point E represented that the finishing temperature in the over aging process was higher than 200 °C The metallographic structure, the tensile strength, the yield strength, and the yield ratio of the obtained high-strength steels were measured in the following evaluation methods. The results were shown in Table 1.

Experimental Example 2 to Experimental Example 4 and Comparative Example 1 to Comparative Example 4

Experimental Example 2 to Experimental Example 4 and Comparative Example 1 to Comparative Example 4 were measured in a manner similar to Experimental Example 1. The differences were that the element contents and the process parameters thereof in each slab of Experimental Example 2 to Experimental Example 4 and Comparative Example 1 to Comparative Example 4 were changed. The specific parameters conditions and the evaluation results of Experimental Example 2 to Experimental Example 4 and Comparative Example 1 to Comparative Example 4 were shown in Table 1.

Evaluation Methods

The metallographic structure, the tensile strength, and the yield strength of the steels were measured using conventional instruments and methods, and the evaluation results were shown in Table 1.

1. Metallographic Structure

In Table 1, "F" represented ferrite, "B" represented bainite, "M" represented martensite, "TM" represented tempered martensite, and "RA" represented residual austenite.

Table 1 showed that all the metallographic structures in Experimental Example 1 to Experimental Example 4 include tempered martensite and ferrite, and all the volume fractions of tempered martensite were not less than 95%. All the volume fractions of tempered martensite of Comparative Example 1 to Comparative Example 4 were less than 95%.

Figure 3:
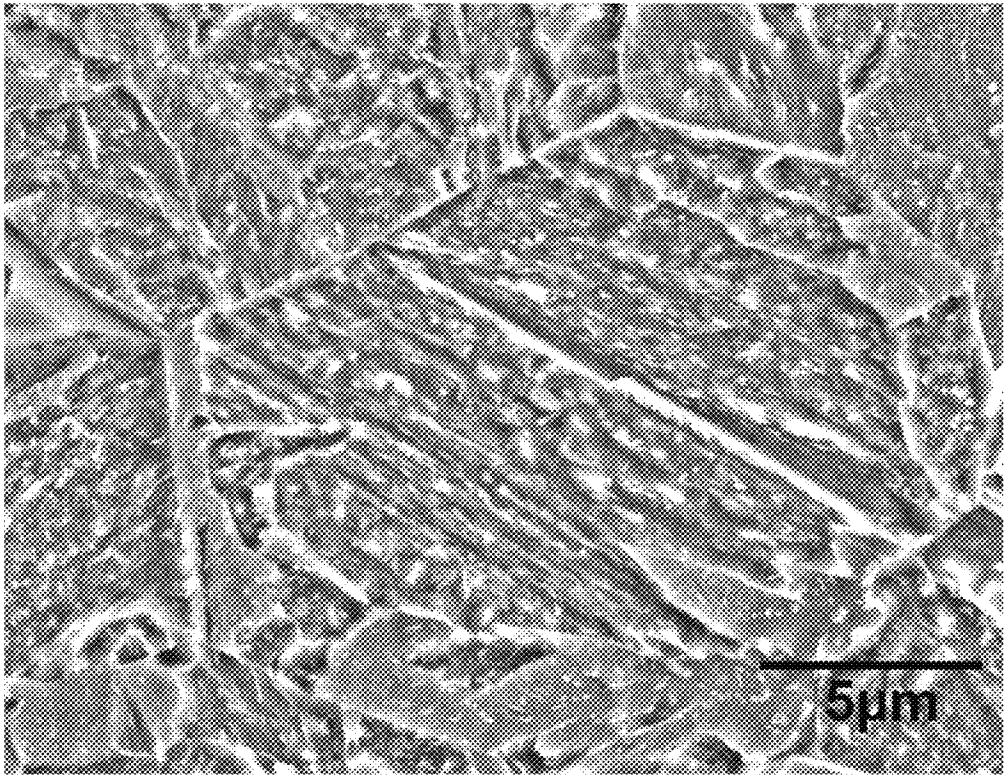
FIG. 3 is a scanning electron microscope image of the high-strength steel according to Experimental Example 3 of the present disclosure.

FIG. 3 was a scanning electron microscope image of Experimental Example 3, wherein most of the metallographic structure in FIG. 3 was tempered martensite.

2. Tensile Strength (TS)

The tensile strength referred herein of the present disclosure was tested according to the No. 5 specimen of the standard method Japanese Industrial Standards (JIS) Z 2241 to measure the tensile strength of the steels of Experimental Example 1 to Experimental Example 4 and Comparative Example 1 to Comparative Example 4, wherein the unit of the tensile strength is MPa. Table 1 showed that all the tensile strengths of Experimental Example 1 to Experimental Example 4 were greater than 1300 MPa.

3. Yield Strength (YS)

The yield strength herein of the present disclosure was tested according to the No. 5 specimen of the standard method Japanese Industrial Standards (JIS) Z 2241 to measure the yield strength of the steels of Experimental Example 1 to Experimental Example 4 and Comparative Example 1 to Comparative Example 4, wherein the unit of the yield strength is MPa. Table 1 showed that all the yield strengths of Experimental Example 1 to Experimental Example 4 were greater than 1050 MPa.

4. Yield Ratio

The yield ratio (YS/TS) herein of the present disclosure was calculated by dividing the tensile strength by the yield strength. Table 1 showed that all the yield ratios of Experimental Example 1 to Experimental Example 4 were greater than 0.8.

The metallographic structures of the steels obtained in Experimental Example 1 to Experimental Example 4 were all tempered martensite and ferrite, and all the volume ratios of tempered martensite were ≥95%.

The method of manufacturing the disclosed high-strength steel excludes retempering, and the steel with the high tensile strength, the high yield strength, and the high yield ratio can be obtained. Therefore, the high-strength steel and the method of manufacturing the same of the present disclosure can reduce the cost and energy loss of manufacturing steel.

The present disclosure has been disclosed as hereinabove, however it is not used to limit the present disclosure. Those skilled in the art may make various changes and alterations herein without departing from the spirit and scope of the present disclosure. Therefore, the scope of protection of the present disclosure shall be subject to the scope of the claims attached in the application.

TABLE 1

| | | Experimental Example 1 | Experimental Example 2 | Experimental Example 3 | Experimental Example 4 | Comparative Example 1 | Comparative Example 2 | Comparative Example 3 | Comparative Example 4 |
|---|---|---|---|---|---|---|---|---|---|
| slab compositions | carbon | 0.24 | 0.22 | 0.24 | 0.16 | 0.22 | 0.16 | 0.24 | 0.2 |
| | silicon | 0.21 | 0.22 | 0.21 | 0.54 | 0.22 | 0.54 | 0.21 | 1.01 |
| | manganese | 1.23 | 1.23 | 1.23 | 1.95 | 1.23 | 1.95 | 1.23 | 2.5 |
| | chromium | 0.22 | 0.23 | 0.22 | 0.52 | 0.23 | 0.52 | 0.22 | — |
| | molybdenum | ≤0.2 | ≤0.2 | ≤0.2 | 0.16 | — | 0.16 | — | — |
| | titanium | 0.023 | 0.0026 | 0.023 | ≤0.05 | 0.0026 | — | 0.023 | — |
| | aluminum | 0.045 | 0.043 | 0.045 | 0.042 | 0.043 | 0.042 | 0.045 | 0.044 |
| | boron | 0.0023 | 0.0025 | 0.0023 | ≤0.004 | 0.0025 | — | 0.0023 | — |
| | nitrogen | 0.0038 | 0.0031 | 0.0038 | 0.0056 | 0.0031 | 0.0056 | 0.0038 | 0.0037 |
| | phosphorus | 0.01 | 0.013 | 0.01 | 0.006 | 0.013 | 0.006 | 0.01 | 0.008 |
| | sulfur | 0.001 | 0.001 | 0.001 | 0.001 | 0.001 | 0.001 | 0.001 | 0.001 |
| | iron and unavoidable impurities | remaining compositions | remaining compositions | remaining compositions | remaining compositions | remaining compositions | remaining compositions | remaining compositions | remaining compositions |
| metallographic structure | | TM + F | TM + F | TM + F | TM + F | TM + F + B | B + F + M | M + F | B + F + M + RA |
| tempered martensite ≥95% | | ○ | ○ | ○ | ○ | X | X | X | X |
| evaluation results | tensile strength(MPa) | 1372 | 1394 | 1407 | 1327 | 1031 | 1068 | 1496 | 1077 |
| | yield strength(MPa) | 1180 | 1146 | 1155 | 1069 | 945 | 855 | 1043 | 792 |
| | yield ratio | 0.86 | 0.82 | 0.82 | 0.81 | 0.92 | 0.8 | 0.7 | 0.74 |

TABLE 2

| | Experimental Example 1 | Experimental Example 2 | Experimental Example 3 | Experimental Example 4 | Comparative Example 1 | Comparative Example 2 | Comparative Example 3 | Comparative Example 4 |
|---|---|---|---|---|---|---|---|---|
| point A | ○ | ○ | ○ | ○ | ○ | X | X | X |
| line segment B | ○ | ○ | ○ | ○ | X | X | X | X |
| point C | ○ | ○ | ○ | ○ | X | X | X | X |
| line segment D | ○ | ○ | ○ | ○ | ○ | ○ | X | ○ |
| point E | ○ | ○ | ○ | ○ | ○ | ○ | X | ○ |

What is claimed is:

1. A method of manufacturing a high-strength steel, comprising:

providing a slab, based on a total weight of the slab as 100% by weight, the slab comprises:

0.16 weight percent to 0.25 weight percent of carbon;

0.15 weight percent to 0.55 weight percent of silicon;

no more than 2 weight percent of manganese;

no more than 0.55 weight percent of chromium;

no more than 0.2 weight percent of molybdenum;

no more than 0.05 weight percent of titanium;

no more than 0.06 weight percent of aluminum;

no more than 0.004 weight percent of boron;

no more than 0.006 weight percent of nitrogen;

no more than 0.02 weight percent of phosphorus;

no more than 0.002 weight percent of sulfur; and a remaining amount of iron and unavoidable impurities;

performing a heating step on the slab to obtain a heated slab;

performing a hot rolling step on the heated slab to obtain a hot rolled steel plate;

performing a cold rolling step on the hot rolled steel plate to obtain a cold rolled steel plate;

performing an annealing step on the cold rolled steel plate to obtain an annealed steel plate;

performing a cooling step on the annealed steel plate to obtain a cooled steel plate, wherein the cooling step comprises the following operations in sequence:

cooling the annealed steel plate to no less than 680 °C at a cooling rate between 5 °C/second and 20 °C/second;

cooling the annealed steel plate to no higher than 400 °C at a cooling rate between 30 °C/second and 300 °C/second; and cooling the annealed steel plate to between 250 °C and 300 °C at a cooling rate between 10 °C/second and 40 °C/second; and performing an over aging process on the cooled steel plate to obtain the high-strength steel, wherein a volume ratio of tempered martensite in the high-strength steel is not less than 95%.

2. The method of manufacturing the high-strength steel of claim 1, wherein:

a heating temperature in the heating step is between 1150 °C and 1300 °C, and the heating step is maintained for 2 hours to 4 hours; and a finish rolling temperature in the hot rolling step is between 880 °C and 950 °C, and a coiling temperature in the hot rolling step is between 500 °C and 700 °C.

3. The method of manufacturing the high-strength steel of claim 1, wherein a cold rolling percentage in the cold rolling step is at least 50%.

4. The method of manufacturing the high-strength steel of claim 1, further comprising:

before the cold rolling step, performing a pickling step on the hot rolled steel plate.

5. The method of manufacturing the high-strength steel of claim 1, wherein an annealing temperature in the annealing step is above 840 °C, and an annealing time in the annealing step is between 90 seconds and 600 seconds.

6. The method of manufacturing the high-strength steel of claim 5, wherein the annealing temperature in the annealing step is between 840 °C and 940 °C.

7. The method of manufacturing the high-strength steel of claim 1, wherein in the step of cooling the annealed steel plate to no higher than 400 °C at a cooling rate between 30 °C/second and 300 °C/second, a cooling temperature of the annealed steel plate is between 300 °C and 400 °C.

8. The method of manufacturing the high-strength steel of claim 1, wherein a processing temperature in the over aging process is between 200 °C and 250 °C, and a processing time in the over aging process is between 2 minutes and 25 minutes.

9. The method of manufacturing the high-strength steel of claim 1, wherein a total volume ratio of ferrite and bainite is no more than 5%.

10. The method of manufacturing the high-strength steel of claim 1, wherein the manufacturing method excludes retempering.

* * * * *